US005366317A

United States Patent [19]

Solimar

[11] Patent Number: 5,366,317

[45] Date of Patent: Nov. 22, 1994

[54] MANHOLE COVER APPARATUS AND METHOD

[76] Inventor: Keith F. Solimar, 1289 Brighton Sq., New Brighton, Minn. 55112

[21] Appl. No.: 999,092

[22] Filed: Dec. 31, 1992

[51] Int. Cl.[5] ..... E02D 29/14

[52] U.S. Cl. ..... 404/25; 52/20; 220/325; 411/98

[58] Field of Search ..... 404/25, 26; 292/102, 292/146, 251; 16/231, 233, 387; 220/342, 337, 319, 324, 325; 411/428, 98, 121, 136

[56] References Cited

U.S. PATENT DOCUMENTS

| | | | |
|---|---|---|---|
| 652,487 | 6/1900 | Powers | 411/98 |
| 1,483,953 | 11/1922 | Rainey | 220/344 |
| 1,520,230 | 12/1924 | Flath | 52/20 |
| 1,534,836 | 4/1925 | Brede et al. | 220/344 |
| 2,663,213 | 10/1950 | Davidson | 411/428 |
| 3,666,134 | 5/1972 | Rauch | 220/344 |
| 3,860,142 | 1/1975 | Jurges | 220/344 |
| 4,807,675 | 2/1989 | Sharp | 141/86 |
| 4,976,576 | 12/1990 | Mahaney, Jr. et al. | 411/121 |
| 5,073,259 | 12/1991 | Solimar | 210/232 |
| 5,304,021 | 4/1994 | Oliver et al. | 411/121 |

OTHER PUBLICATIONS

*Modern Bulk Transporter*, vol. 55, No. 6, cover page, pp. 4 and 11, dated Dec., 1992. (Exhibit A).

A Knappco document entitled "Knappco Is Progressive", two cover pages, pp. A-1 through 16, pp. B-1 through 50, pp. F-1 through 4, and a 16 page price list dated Jun. 1, 1990. (Exhibit B).

A Fort Vale Engineering Ltd. document entitled "Manlids", 44 pages, dated 1989. (Exhibit C).

A Perolo document entitled "Tank Containers Equipments", 1 page, with 8 page attachment entitled Manlids, dated Oct., 1989. (Exhibit D).

A Fruehauf document for a Manhole Assmelby 20" Full Opening, 2 pages, dated May, 1980. (Exhibit E).

A Knappco document entitled "KW 20" Full Opening High Pressure Manhole", 2 pages, dated Jan., 1987. (Exhibit F).

A Butler Manufacturing Company drawing dated Jun. 22, 1977. (Exhibit G).

A J & L Tank Company specification sheet, one page. (Exhibit H).

ISO Standard for Man-holes and Man-hole Lids for Tank Containers for Liquids and Pressurized Dry Bulk, 2 pages. (Exhibit I).

*Primary Examiner*—Michael Powell Buiz
*Assistant Examiner*—Pamela Anne O'Connor
*Attorney, Agent, or Firm*—Merchant, Gould, Smith, Edell, Welter & Schmidt

[57] ABSTRACT

A manhole cover apparatus including a collar defining an opening with an inner perimeter is provided with a pivotally mounted cover having an outer perimeter greater than the inner perimeter of the collar. A seal is provided to seal between the cover and the collar. Closure structure is provided to secure the free end of the cover to the collar. A threaded bolt is provided to close the cover. A pivotally mounted lever arm is mounted to the bolt for turning of the bolt. An adjustable threaded hinge is provided to adjust the cover in a longitudinal direction relative to the collar. The manhole cover apparatus is useable on pressure containers, such as those used to pneumatically handle particulate material.

22 Claims, 7 Drawing Sheets

MANHOLE COVER APPARATUS AND METHOD

FIELD OF THE INVENTION

The present invention relates generally to manhole covers for manholes. The present invention relates particularly to manhole covers for manholes on pressurized containers.

BACKGROUND OF THE INVENTION

Manholes are known for providing an opening through a structure. A cover may be provided to close the opening at a desired time. Manholes may be used in connection with containers for holding various materials. Containers are known for storing and/or transporting materials such as dry bulk material including flour, sugar, grain, fertilizer, plastic pellets, cement, and other particulate materials. Containers for storing the material include trailer tanks, rail cars, storage tanks, and the like. Access to the containers may be provided through a manhole which defines an opening into the container for such purposes as filling the container with the material, and also for providing access to the interior of the container for persons needing to view or work on the interior structures of the container. A manhole cover may be provided to close the manhole opening at the desired time such as to protect the interior of the container and its contents.

Pneumatic particulate handling systems are known for use in unloading particulate material from a container pneumatically with the use of a stream of air. Such systems are commonly used, for example, to load the material into the container of a truck trailer from another container, such as a rail car. Manhole openings may be provided to access the interior of the container for filling the container. For subsequent emptying of the container, another access opening is usually provided besides the manhole opening for which the material can exit the container pneumatically. There is a need to sealably close the manhole openings to the container to maintain an environment in the container which is at a pressure greater than atmospheric pressure during the pneumatic unloading operation.

Various concerns exist in the area of manhole covers generally and specifically in the case of providing manhole covers in pressure environments. One concern is that the manhole cover be easy to use. Another concern is that the manhole cover be safe to operate. A further often encountered concern is that the manhole cover have a low profile so as to minimize the overall height of the tank. Also, it is important that the manhole cover be easy to manufacture, and easy to maintain in an operable condition once installed. There is a need in the art for a manhole cover apparatus and method which addresses the above concerns and other concerns.

SUMMARY OF THE INVENTION

The present invention relates to a manhole cover apparatus including a collar with an opening having an inner perimeter, and a cover having an outer perimeter greater than the inner perimeter of the collar. Hinge structure is provided to hingedly connect the cover to the collar. Closure structure is provided to close the free end of the collar relative to the cover when the cover is positioned over the opening defined by the collar. Preferably, seal structure, such as a gasket, is provided to seal between the cover and the collar. The collar is mountable to a particulate material handling container used for storage and/or transport of the material. The manhole cover apparatus provides selective access to the interior of the container.

In one aspect of the invention, threaded closure structure is provided to threadably move the free end of the cover relative to the collar in order to close the opening. A lever arm is pivotally mounted to the threaded closure structure for turning the threaded closure structure relative to the cover and the collar. The threaded closure structure may include a block pivotally mounted to the collar, a threaded opening in the block, a threaded rod member, such as a bolt, threaded into the block, and a projection extending from the cover and defining a slot for receipt of the bolt. The lever arm may include a yoke which surrounds a portion of the head of the bolt. The lever arm provides convenient structure for turning the head of the bolt. The lever arm saves the operator from having to provide a wrench or other tool to turn the bolt. Also, the lever arm is of a sufficient length to provide mechanical advantage for the operator to turn the bolt when such turning may be difficult or impossible by hand.

Another aspect of the invention relates to threadably adjustable hinge structure which hingedly mounts the cover to the collar to permit a preselectable range of longitudinal movements of the cover relative to the collar. The threadably adjustable hinge structure may include a block pivotally mounted to the collar, a threaded opening in the block, a threaded rod member, such as a bolt, threaded into the opening of the block, and a projection extending from the cover defining an opening for receipt of the bolt. Lock structure may also be provided to prevent turning of the bolt during closure of the cover relative to the collar. Projections may further be provided relative to the hinge structure such that only predetermined motions of the cover relative to the collar are possible during pivoting movement of the cover relative to the collar.

A further aspect of the invention relates to the interchangeability of some of the structures comprising the hinge structure and the closure structure. The pivoting blocks may be identical such that each block can serve either function, as a hinge block or as a closure block, depending on the orientation of the cover.

Another aspect of the invention relates to the cover being provided with a recess for receipt of the lever arm once the cover is operatively positioned over the manhole opening. The recess provides for a lower overall cover height and positions the lever arm in a region which protects the lever arm and maintains the lever arm from turning once the cover is locked.

Further aspects of the invention relate to structures provided on the cover to permit pressure environments of at least about 15 pounds per square inch (p.s.i.) and greater, such as 30 p.s.i.

These and other aspects of the invention will be discussed in greater detail below.

BRIEF DESCRIPTION OF THE DRAWINGS

In the drawings, where like numerals refer to like components throughout the several views.

DETAILED DESCRIPTION OF A PREFERRED EMBODIMENT

Figure 1:
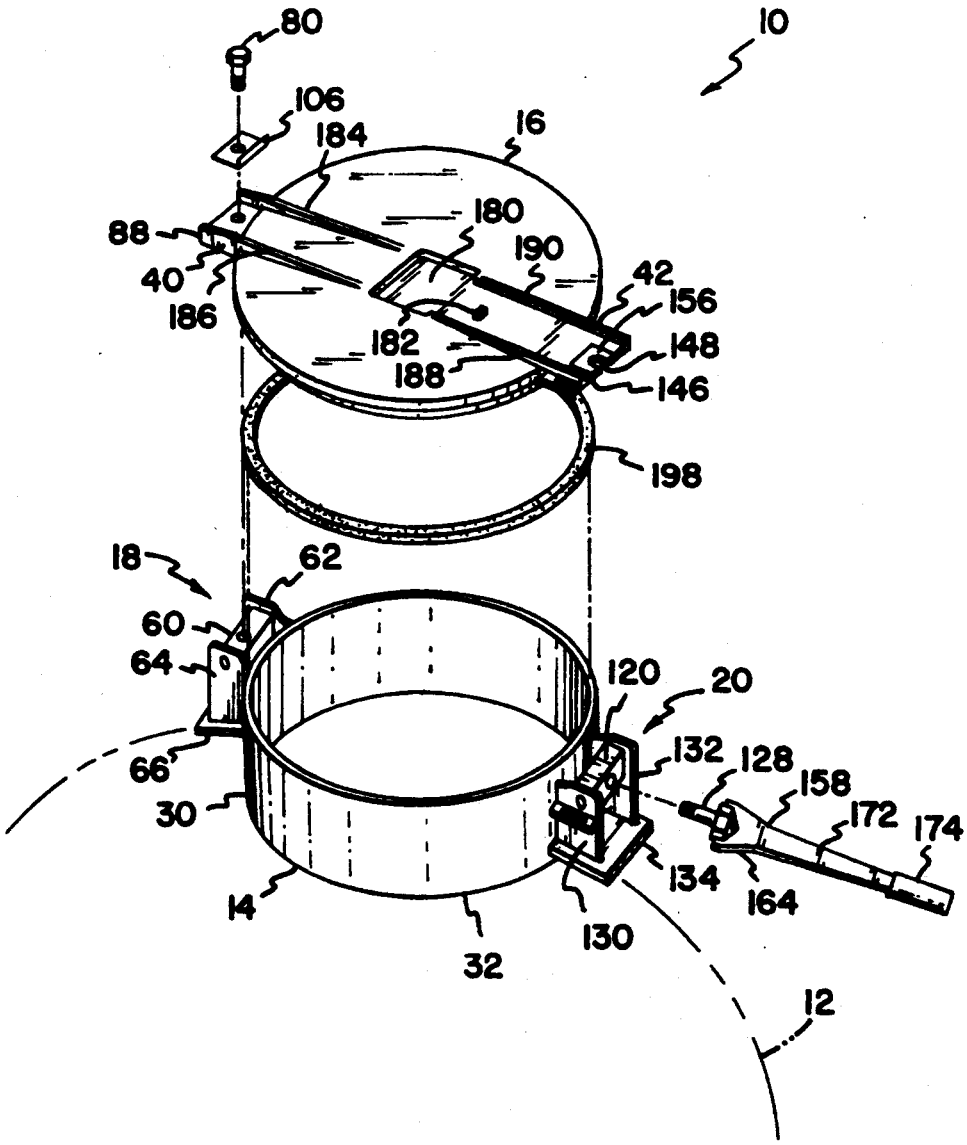
FIG. 1 is a perspective assembly view of one preferred embodiment of a manhole cover apparatus according to the present invention.

Referring now to FIG. 1, there is shown a manhole cover apparatus 10 mounted to container 12. Container 12 can be a variety of containers such as rail cart a trailer, a storage tank, or the like. In FIG. 1, container 12 is shown as having a curved upper half. Manhole cover apparatus 10 provides access to an interior of container 12. Manhole cover apparatus 10 also closes access to container 12 when access is no longer desired. Such may be the case to protect the contents of the container, or to permit the creation of a pressure environment in the container 12, as during pneumatic unloading.

Manhole cover apparatus 10 includes a collar 14 which is attached to container 12. If container 12 and collar 14 are made from metal, collar 14 can be welded directly to container 12. Manhole cover apparatus 10 further includes a cover 16 which is pivotally mounted to collar 14 with a hinge assembly 18. Hinge assembly 18 permits pivotal movement of cover 16 relative to collar 14 to move cover 16 to a variety of desired positions, such as fully open, fully closed, or positions in between. A closure assembly 20 is provided to secure cover 16 to collar 14 when cover 16 is in the closed position.

Figure 2:
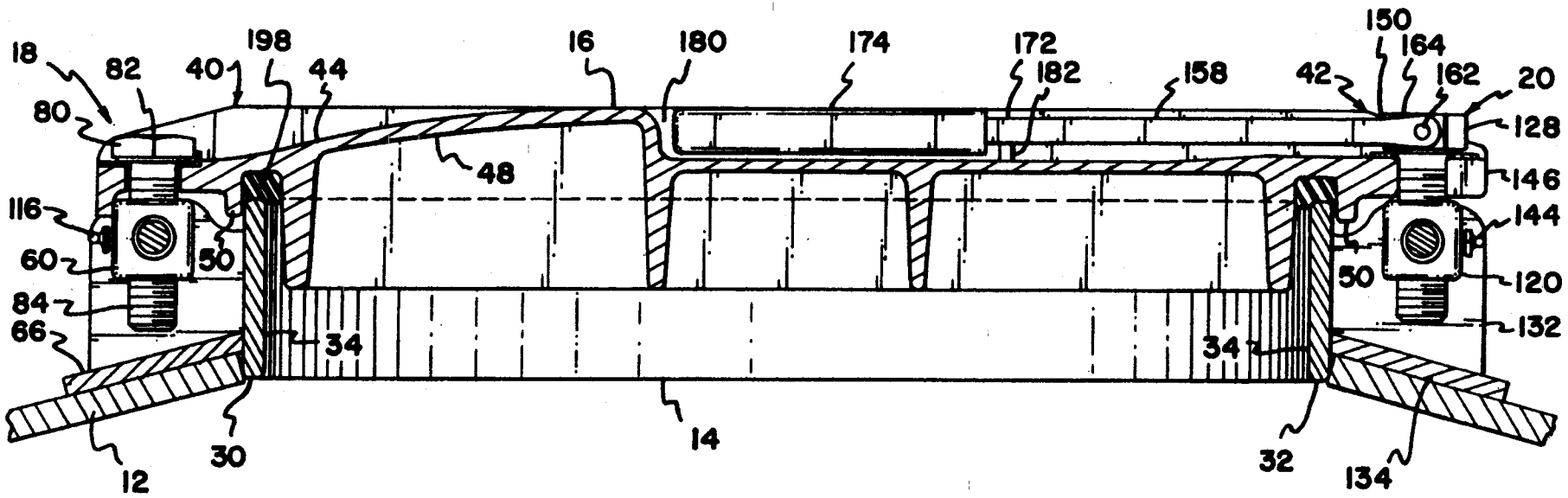
FIG. 2 is an enlarged cross-sectional view of the manhole cover apparatus shown in FIG. 1.

As shown in FIG. 2, a first portion 30 of collar 14 is hingedly connected to a first portion 40 of cover 16 through hinge assembly 18. Second portion 42 of cover 16 defines a free end which is pivotally movable toward and away from second portion 32 of collar 14. Collar 14 includes an inner surface or perimeter 34 which defines an opening which is usable to access the interior of the container. Cover 16 includes a top surface 44 and a bottom surface 48. An edge 50 defines an outer perimeter of cover 16 which is larger than inner perimeter 34 of collar 14.

Figure 4:
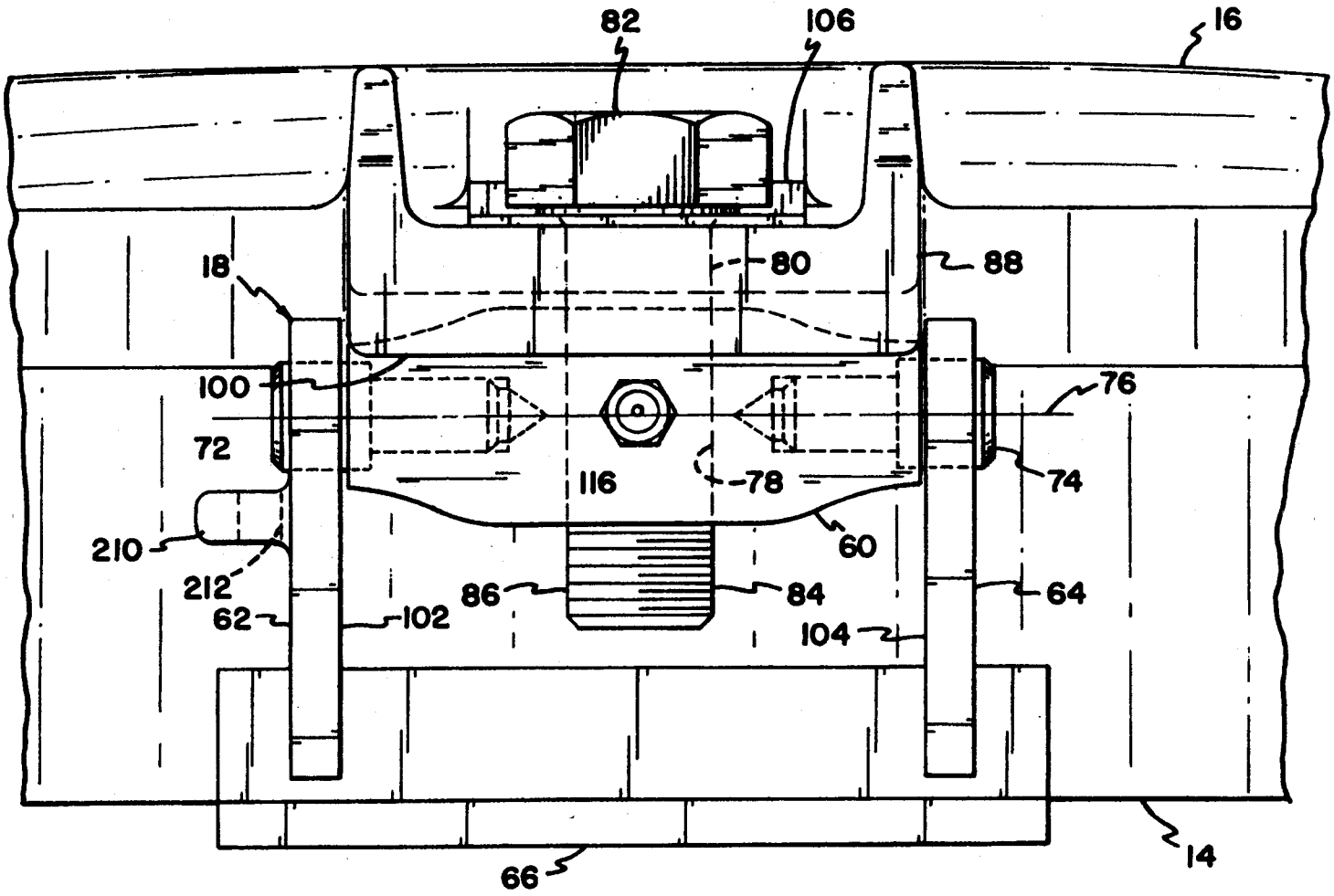
FIG. 4 is an enlarged end view of the manhole cover apparatus shown in FIG. 1, showing the hinge structure.
Figure 6:
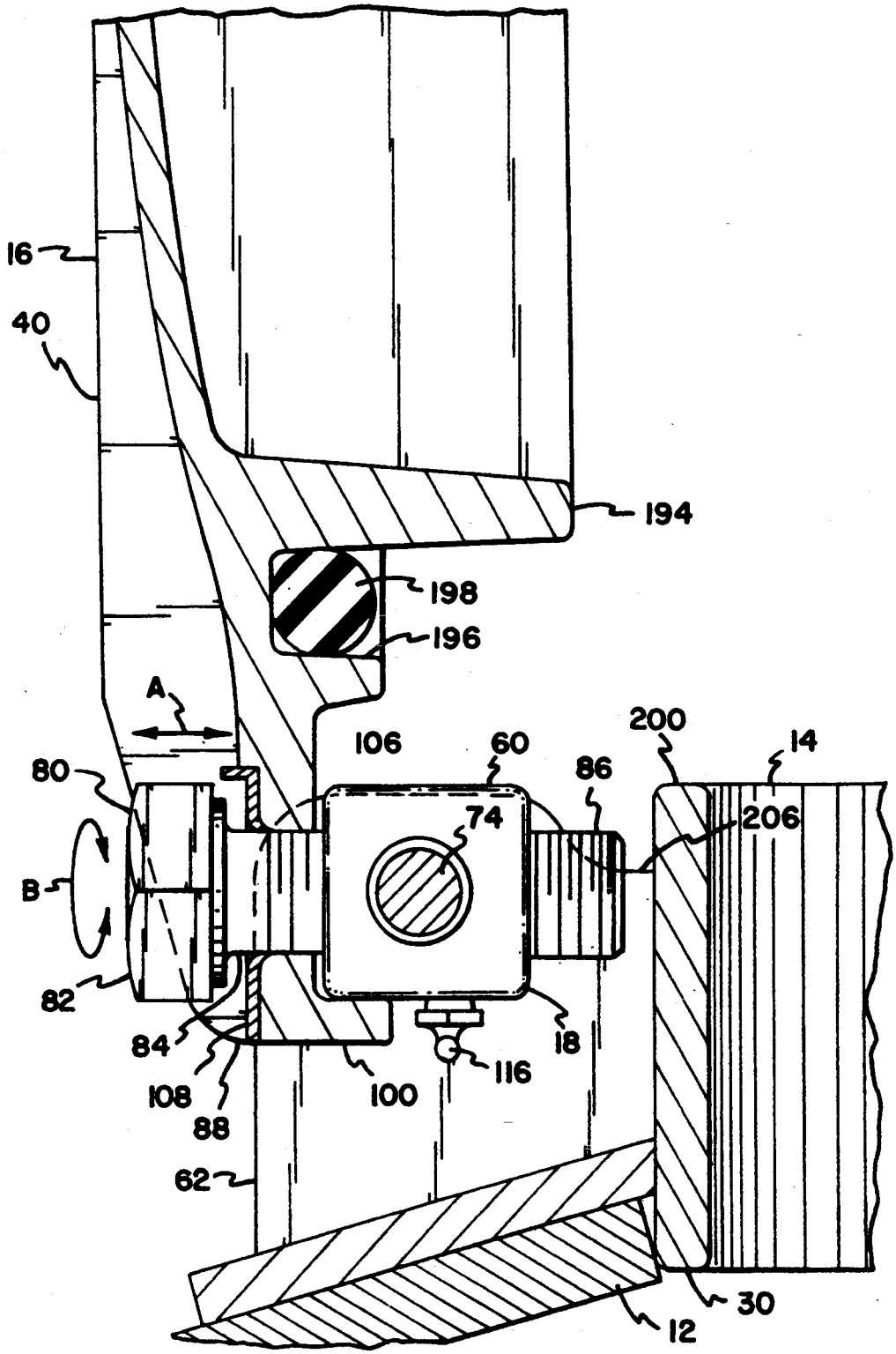
FIG. 6 is an enlarged cross-sectional view of the a portion of the hinge structure of the manhole cover apparatus shown in FIG. 1.

As shown for example in FIGS. 2, 4, and 6, hinge assembly 18 includes a pivot block 60 which is rotatably mounted to collar 14. Two hinge plates 62, 64 extend from collar 14. A pad 66 extends from collar 14 and provides structural support for the hinge plates 62, 64. Hinge plates 62, 64 each include an aperture for receipt of shaft members 72, 74 extending from pivot block 60. Shaft members 72, 74 define a pivot axis 76 about which pivot block 60 rotates relative to hinge plates 62, 64. Pivot block 60 includes an aperture 78 therethrough with threads for receipt of a threaded bolt 80 or other threaded rod member. Threaded bolt 80 includes a head 82 and a shaft 84 with a threaded portion 86.

Figure 3:
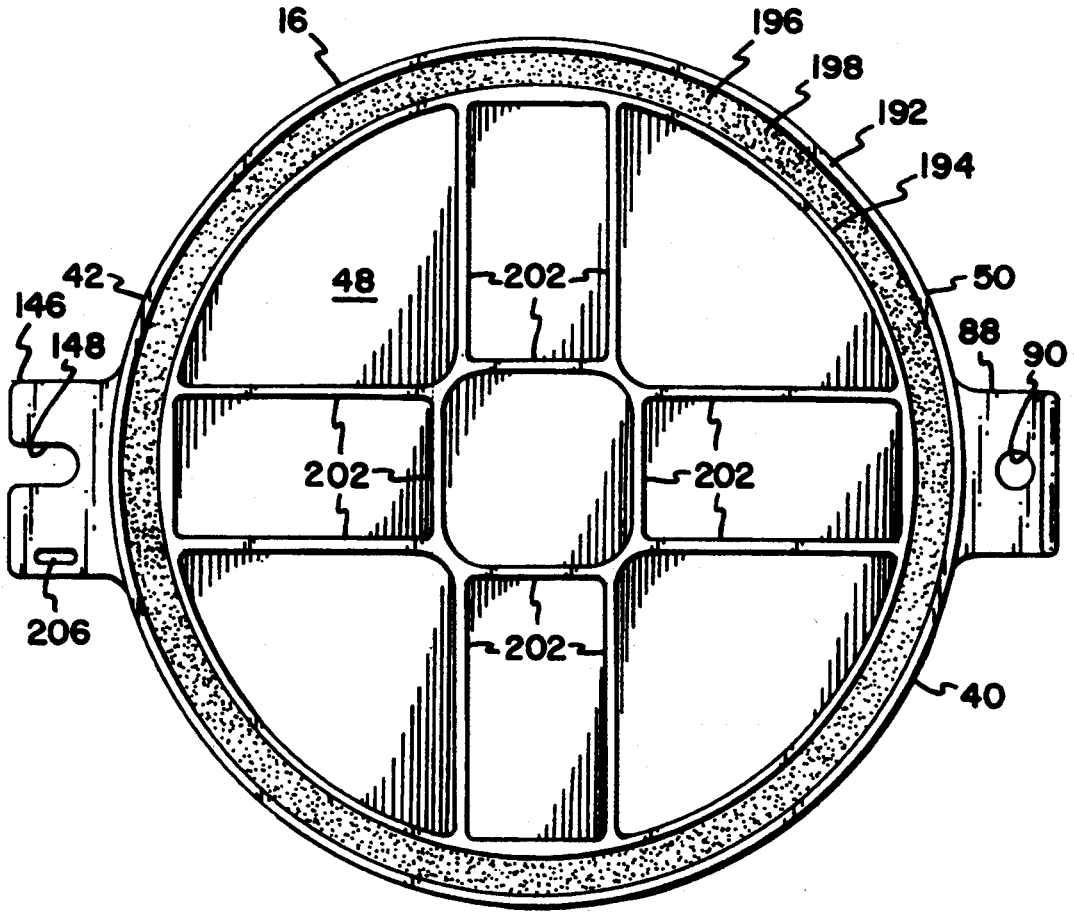
FIG. 3 is an enlarged bottom plan view of the cover of the manhole cover apparatus shown in FIG. 1.

As best shown in FIG. 3, extending from cover 16 is a first projection 88 which defines an opening 90 for receipt of bolt 80. Bolt 80 mounts cover 16 to pivot block 60 which permits pivotal movement of cover 16 relative to collar 14 about pivot axis 76, as shown in FIG. 4.

As shown in FIGS. 4 and 6, first projection 88 includes a projection or lip 100 which is sized to fit between the spaces separating hinge plates 62, 64 when cover 16 is pivoted away from collar 14 when access to the container would be provided. Lip 100 provides a limit to the amount of relative twisting movement between cover 16 and collar 14 which is not about pivot axis 76. Because there is a single bolt 80 mounting cover 16 to collar 14, there is a potential for some twisting relative movement of cover relative to collar 14 about axes other than axis 76. Lip 100 is engageable with the inside surfaces 102, 104 of hinge plate 62, 64, respectively to limit relative twisting movement about axes other than pivot axis 76.

Hinge assembly 18 is threadably adjustable to permit adjustment of the longitudinal position of cover 16 relative to collar 14. Bolt 80 is threadably positionable in a variety of positions relative to pivot block 60 wherein head 82 defines a predetermined range of movement along shaft 84 of cover 16. By manually turning bolt 80, this range is adjustable. Such adjustability is useful to better align cover 16 relative to collar 14. Such adjustability further helps de-emphasize extremely precise positioning of hinge assembly 18, including the hinge plate 62, 64 during manufacture. Also, variations in the resilient seal structure can be compensated for by the threaded adjustability of hinge assembly 18.

Hinge assembly 18 further includes structure for limiting rotation of bolt 80 once cover 16 is operatively positioned relative to collar 14 to close the opening. A plate 106 is provided with a base portion 108 defining an aperture for receipt of bolt 80. A lip 112 extends from plate 106 and engages a flat surface on head 82 of bolt 80. Bolt 80 may be provided with a hex head, a four-sided head or other structure including at least one flat side for engagement with lip 112. To rotatably adjust the threaded portion 86 of bolt 80 relative to the threaded aperture 78 of pivot block 60, cover 16 is generally rotated away from collar 14 such that cover 16 can be pushed along shaft 84 in the direction of arrow A of FIG. 6 such that lip 112 is not in engagement with one of the flat sides of head 82. Bolt 80 can then be rotated in the direction of arrow B. It is to be appreciated that lip 112 could be an integral structure on cover 16.

Pivot block 60 includes a small aperture which is provided with a grease fitting 116. Grease fitting 116 is usable with a grease gun tool (not shown) for injecting a small amount of grease into aperture 78. Grease fitting 116 permits lubrication of threaded aperture 78 to facilitate smooth operation of bolt 80 in the various anticipated environments involving particulate material that could become lodged in the hinge structure and thereby possibly cause problems with rotation of bolt 80 to a new position.

Figure 5:
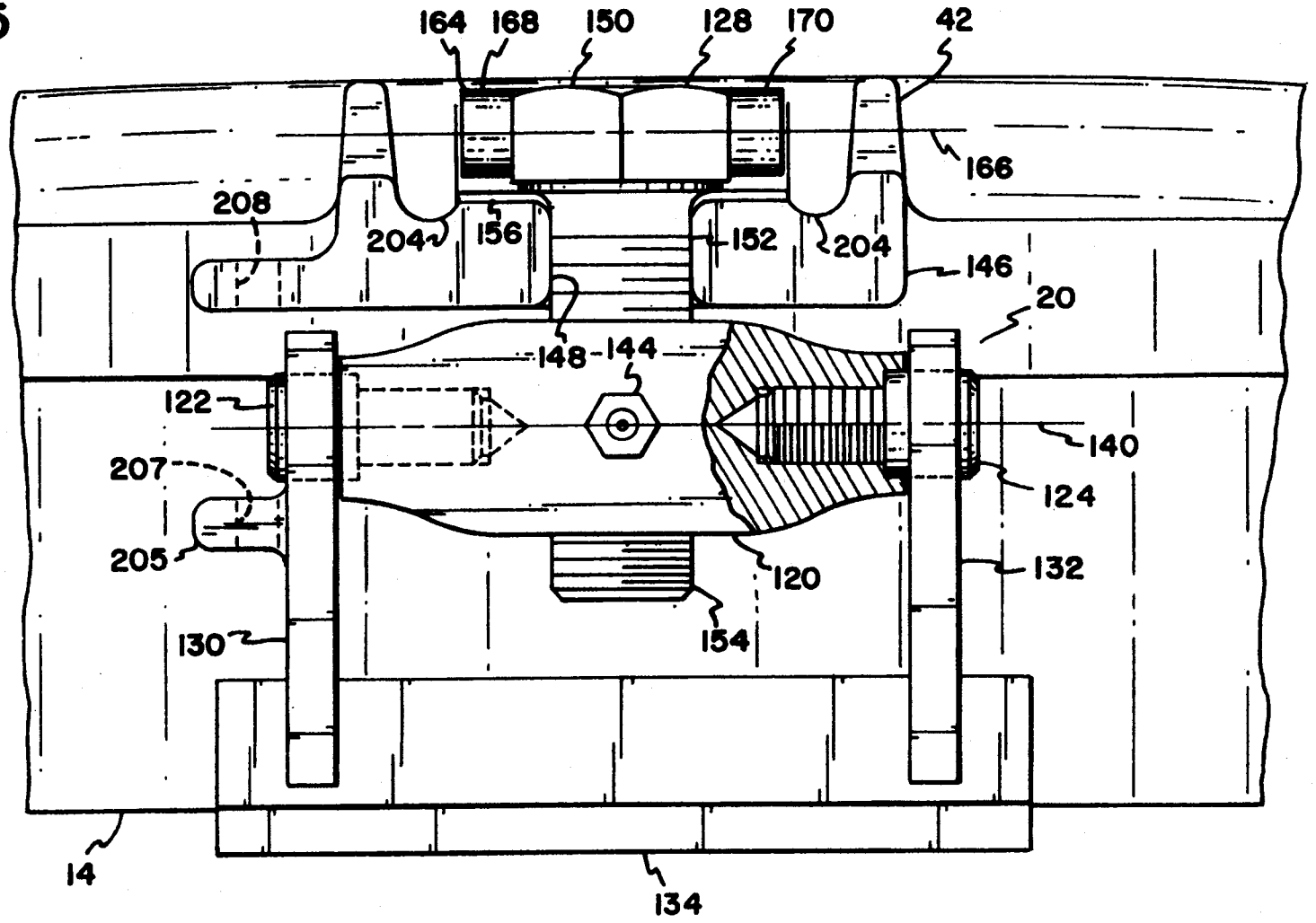
FIG. 5 is an enlarged end view of the manhole cover apparatus shown in FIG. 1, showing the closure structure.
Figure 7:
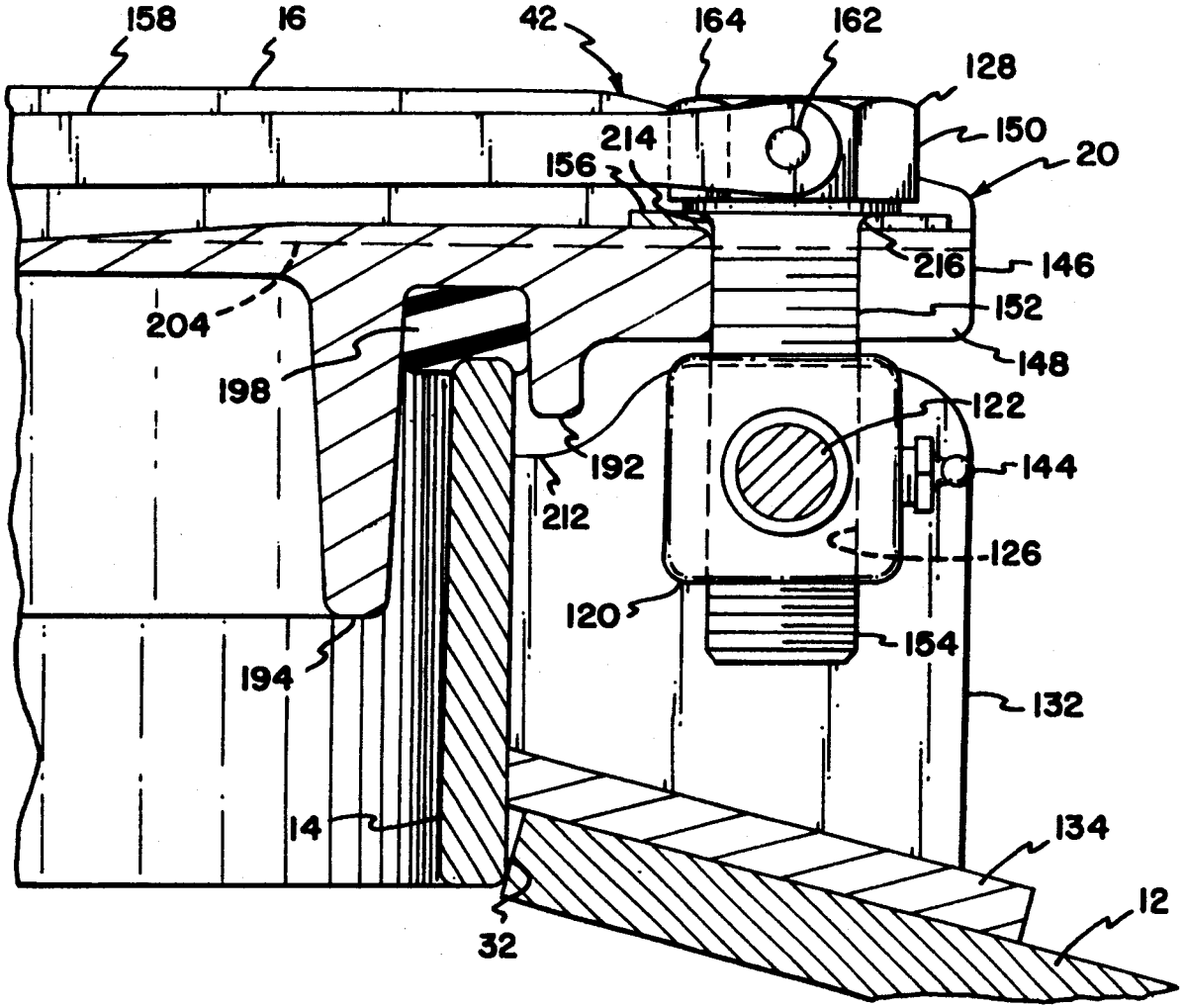
FIG. 7 is an enlarged cross-sectional view of a portion of the closure structure of the manhole cover apparatus shown in FIG. 1.

Referring now to FIGS. 2, 5, and 7 for example, closure assembly 20 includes a pivot block 120 with shaft members 122,124 extending from pivot block 120. An aperture 126 is provided with threads for receipt of a bolt 128 or other threaded rod member. Hinge plates 130, 132 extend from collar 14 adjacent second portion 32. A pad 134 extends from collar 14 and provides support for hinge plates 130, 132. Apertures are provided in each hinge plate 130, 132 respectively for receipt of one of shaft members 122,124 to pivotally mount pivot block 120 to collar 14 for rotation about a pivot axis 140.

Pivot block 120 includes a small aperture for receipt of a grease fitting 144 to permit lubrication of aperture 126. Grease fitting 144 is usable with a grease gun tool for injecting a small amount of grease into aperture 126.

Extending from cover 16 adjacent second portion 42 is a second projection 146 which defines a slot 148 for receiving bolt 128 to close cover 16 relative to collar 14. Bolt 128 includes a head 150 and a shaft 152 extending therefrom with a radially enlarged transition portion therebetween. A portion of shaft 152 is receivable in slot 148 when cover 16 is in the closed position relative to collar 14. Shaft 152 includes a threaded portion 154. Threaded portion 154 is received by aperture 126 in pivot block 120. Head 150 engages the sides of projection 146 defining the slot 148 to hold cover 16 closed in operation. In the preferred embodiment, a wear plate 156 may be provided to protect cover 16. Wear plate 156 may be an insert provided with a slot structure and may be cast in place if cover 16 is made in a casting process.

Mounted to head 150 of bolt 128 is a lever arm 158. Head 150 includes a bore transverse to the axis for receipt of a pin 162. Lever arm 158 includes a first end 164 defining a yoke arrangement which cooperates with pin 162 to pivotally mount lever arm 158 to bolt 128 for pivotal movement of lever arm 158 about an axis 166. Pin 162 may be a press fit type pin which cooperates with recesses on each arm 168, 170 of yoke 164. Lever arm 158 includes a free end 172 for convenient grasping by the hand of the operator who desires to turn bolt 128. A rubber member 174 may be provided to facilitate secure and comfortable gripping of lever arm 158.

To close cover 16 relative to collar 14 when the closure assembly is in the unsecured state, cover 16 is positioned over the opening defined by collar 14, and bolt 128 is positioned in aperture 126. Lever arm 158 is grasped by the operator and bolt 128 and pivot block 120 is pivoted toward slot 148 for receipt of shaft 152 within slot 148. With the longitudinal direction of lever arm 158 at a convenient angle relative to the longitudinal direction of bolt 128, the operator is provided with a mechanical advantage to rotate lever arm 158 to turn bolt 128 to threadably turn the threaded portion 154 into threaded aperture 126 of block 120, thereby tightening down second portion 42 of cover 16 relative to second portion 32 of collar 14. Once an appropriate amount of the tightening down of cover 16 has occurred, lever arm 158 is released by the operator, at which point lever arm 158 rests on cover 16. Some forward rotation or backward rotation of bolt 128 may be required in order to obtain a desired positioning of lever arm 158 relative to cover 16.

To open cover 16 relative to collar 14 when the closure assembly is in the secured state, lever arm 158 is lifted and grasped at a convenient angle by the operator. Lever arm 158 is rotated to turn bolt 128 to threadably turn the threaded portion 154 out of threaded aperture 126 of block 120. This loosens second portion 42 of cover 16 relative to second portion 32 of collar 14. As the cover 16 is loosened, any pressure in container 12 is safely released. Bolt 128 is rotated further so as to threadably disengage aperture 126. The cover may then be lifted and pivoted up about hinge assembly 18.

Pivoting blocks 60, 120 are preferably identical such that each block can serve either function, as a hinge block or as a closure block, depending on the orientation of the cover.

Top surface 44 of cover 16 defines a recessed region 180 to receive lever arm 158. Recessed region 180 provides a lower overall height, helps protect lever arm 158, and also keeps lever arm 158 in a predefined place. A stand 182 projects from cover 16 to position lever arm 158 at a spaced apart distance from top surface 44 of cover 16 within recessed region 180. Stand 182 is useful in preventing water from freezing lever arm 158 to cover 16. Also, the spaced apart distance provides a space for easy grasping of lever arm 158 by the operator when the operator positions the operator's fingers underneath the lever arm 158.

Cover 16 includes rail members 184, 186 adjacent hinge assembly 18 and rail members 188, 190 adjacent closure assembly 20. Rail members 184, 186, 188, 190 provide structural support for cover 16 and are integral with cover 16. Also, the rails provide protection for the respective structures of hinge assembly 18 and closure assembly 20 from damage caused by contact from side loads applied to manhole cover apparatus 10.

As shown in FIG. 6, cover 16 includes an outer lip 192 and an inner lip 194 which define a space 196 for receipt of a gasket 198. In operation, a top edge 200 of collar 14 is received by space 196 and engages gasket 198 to sealably mount cover 16 to collar 14.

Bottom surface 48 of cover 16 includes a plurality of strengthening members 202 which strengthen cover 16 for pressure environments. Strengthening members 202 are relatively thin beam members and provide strength without excessively creating a heavy cover 16. Further, strengthening members 202 fit down inside at least partially in collar 14, as best seen in FIG. 2. This is advantageous in that cover 16 does not excessively create a high profile for manhole cover apparatus 10. In many storage and/or transport environments, there are total height restrictions on container 12 and any protruding structures such that increases in the height of manhole cover apparatus 10 could reduce the available storage volume of container 12. Strengthening members 202 define four generally wedge-shaped regions, four generally elongated rectangular regions, and a central generally square region.

As shown in FIG. 5, top surface 44 of cover 16 further includes drainage troughs 204 to facilitate the drainage of water away from cover 16. Container 12 is typically domed at its upper surface to also facilitate drainage.

Hinge plates 62, 64 include a recessed region, like region 206 shown in FIG. 6 for receipt of outer lip 192 of cover 16. Similarly, hinge plates 130, 132 include a recessed region, like region 212 shown in FIG. 7 for receipt of outer lip 192. These recesses cooperate to minimize the profile of manhole apparatus 10. Positioning hinge assembly 18 and closure assembly 20 away from the highest point of container 12, as shown in FIG. 1, helps to keep the profile defined by manhole cover assembly 10 lower.

Wear plate 156 on cover 16 may include a radiused region 214 for receipt of radiused region 216 of bolt 128 between shaft 152 and head 150. This assists in proper positioning of bolt 128 in slot 148 and serves to limit or restrict movement of bolt 128 out of slot 148 during closure of manhole cover apparatus 10 by the operator.

It is to be appreciated that cover 16 can be made from a variety of materials in a variety of manufacturing processes. Cover 16 with its associated projections can be made from metal including stainless steel, steel, or aluminum and can be cast or machined. Plastics are also anticipated as potentially useful for cover 16. Collar 14 and the associated separate components of hinge assembly 18 and closure assembly 20 not integrally formed with cover 16 can be made from a variety of materials including aluminum, steel or stainless steel. If cover 16 is made from aluminum, it is preferred that wear plate 106 be provided of a different material such that cover 16 is protected from engagement by bolt 80. Similarly, plate 106 would protect cover 16 from bolt 128 during operation. Hinge plates 62, 64, 130, 132 and pads 66, 134 can be welded to collar 14.

Gasket 198 can be made from a variety of resilient materials for providing a seal between cover 16 and collar 14, including rubber tubing.

Manhole cover apparatus 10 is capable of withstanding pressures of 15 p.s.i., and possibly as high as 30 p.s.i. In some cases, tests have shown pressures as high as about 60 to 65 p.s.i. are possible.

As best shown in FIG. 5, manhole cover apparatus 10 includes tamper-evident features. A first tab 205 extends from hinge plate 130 of the closure assembly 20. First tab 205 defines an opening 207. A second tab 206 extends from projection 146 of the closure assembly 20. Second tab 206 defines an opening 208. The openings 207, 208 are useable for receipt of an identification ring, such as plastic or wire (not shown). The identification ring would break or would need to be cut if someone opened the manhole cover apparatus 10. In this manner, unauthorized tampering would be evident.

As shown in FIG. 4, hinge assembly 18 is provided with a tab 210 which defines an opening 212 for tamper-evident purposes. Tab 210 and opening 212 is only utilized when cover 16 is oriented 180 degrees relative to collar 14 from the position shown in FIG. 1, wherein block 60 would be serving in a closure function. As noted above, the pivot blocks 60, 120, and the hinge plates 62, 64, 130, 132, and pads 66, 134 can serve in either function, a hinge function or a closure function depending on the orientation of the cover relative to the collar.

The invention is not to be construed as to be limited to the specific embodiment shown in the drawings, but is to be limited only by the broad general meaning of the following claims.

What is claimed is:

1. A method of using a manhole apparatus, comprising the steps of:

providing a cover, a collar defining a manhole opening into a pressure container, and hinge means pivotally mounting the cover to the collar;

pivoting the cover toward the collar;

positioning a threaded bolt pivotally mounted to the collar in a slot defined by the cover;

rotating the threaded bolt with a lever arm pivotally mounted to the bolt to gradually and increasingly seal the cover to the collar; and once the cover is sealed to the collar, pivoting the lever arm toward the cover until the lever arm is engaged with a portion of the cover.

2. The method of claim 1, further comprising the step of placing the lever arm in a recess in the cover once the cover is sealed to the collar.

3. The method of claim 2, further comprising the step of pressurizing the pressure container to a pressure different from atmospheric pressure.

4. The method of claim 1, further comprising the steps of:

providing threaded adjusting means including a rotatable member to adjust the longitudinal position of the cover relative to a pivot axis defined at the hinge means for pivotal movement between the cover and the collar; and rotating the rotatable member of the threaded adjusting means to adjust the longitudinal position of the cover relative to the pivot axis.

5. A manhole apparatus comprising:

a collar having an inner perimeter defining an opening, the collar including a first portion and a second portion oppositely disposed on the collar;

a cover having an outer perimeter greater than the inner perimeter of the collar, the cover including a first portion and a second portion oppositely disposed on the cover, the second portion of the cover including a projection defining a slot;

a hinge disposed at the first portion of the collar connecting the first portion of the cover to the first portion of the collar, the second portion of the cover defining a free end pivotally movable relative to the second portion of the collar;

a block pivotally mounted to the second portion of the collar, the block including a threaded opening;

a rod member including an enlarged head and a shaft extending from the head, the shaft received by the slot of the cover, the head engaged with the projection of the cover, the shaft including a threaded portion disposed in the threaded opening of the block, the rod member further rotatable relative to the block to move the second portion of the cover relative to the second portion of the collar to close the cover to the collar; and a lever arm pivotally mounted to the head of the rod member for rotation thereof, the lever arm being devoid of cam means, whereby the cover is secured solely by threaded action of the rod member.

6. The apparatus of claim 5, wherein the cover includes a top surface, the top surface defining a recess for receiving the lever arm.

7. The apparatus of claim 6, wherein the top surface defines a moisture drainage trough in the recess.

8. The apparatus of claim 5, wherein the rod member is a bolt and the head has a plurality of flat sides.

9. The apparatus of claim 5, wherein the block includes a grease fitting for lubrication of the threaded opening.

10. The apparatus of claim 5, wherein the lever arm includes a yoke surrounding a portion of the head of the rod member.

11. The apparatus of claim 5, wherein the cover includes two spaced apart rail members projecting outwardly from the cover and positioned on opposite sides of the lever arm.

12. The apparatus of claim 5, wherein the hinge includes:

a block pivotally mounted to the first portion of the collar, the block including a threaded opening; and a rod member extending from the cover, the rod member including a threaded shaft positioned in the threaded opening of the block.

13. The apparatus of claim 5, wherein the cover includes an outer lip and an inner lip, and a seal member to seal between the cover and the collar.

14. The apparatus of claim 5, further comprising a strengthening member extending from the cover toward the collar generally parallel to the lever arm.

15. A manhole apparatus comprising:

a collar having an inner perimeter defining an opening, the collar including a first portion and a second portion oppositely disposed on the collar;

a cover having an outer perimeter greater than the inner perimeter of the collar, the cover including a first portion and a second portion oppositely disposed on the cover, the first portion of the cover including a projection defining an aperture an underside of the cover having an annular groove with a resilient gasket disposed therein engaged by the collar whereby the gasket biases the cover away from the collar and provides a seal therebetween;

a block pivotally mounted to the first portion of the collar, the block including a threaded opening;

a rod member including an enlarged head with a plurality of flat sides and a threaded shaft extending from the head, the threaded shaft passing through an aperture in the cover, the head engaged with the projection of the cover, the threaded shaft threadably engaged with the threaded opening in the block, the block axially spaced from the portion of the cover having the aperture therein to permit movement of collar along the shaft in the direction of the block when the cover is opened;

a lock member carried by the cover and having a portion extending axially and threaded to engage one of the flat sides of the head of the rod member, the lock member engaged with one flat side when the cover is in a closed position, the lock member only movable away from the flat side when the cover is in an open position; and a closure arrangement selectively holding the second portion of the cover and the second portion of the collar from relative pivotal movement.

16. The apparatus of claim 15, wherein the block includes a grease fitting for lubrication of the threaded opening.

17. The apparatus of claim 15, wherein the cover includes a hinge projection, and the collar includes a hinge projection, wherein the block pivots about a rotation axis, and the hinge projection of the cover is engageable with the hinge projection of the collar to limit rotation of the cover relative to the collar about axes different from the rotation axis defined by the block.

18. The apparatus of claim 15, wherein the block includes two shaft members projecting from the block, and the collar includes two plates extending from the collar, each plate including an aperture for receiving one of the shaft members of the block.

19. The apparatus of claim 18, wherein the rod member is a first rod member, the projection is a first projection and the block is a first block, and wherein the closure arrangement includes:

a second projection extending from the cover and defining a slot;

a second block including a threaded opening and two shaft members projecting from the second block;

two additional plates extending from the collar, each additional plate including an aperture for receiving one of the shaft members of the second block;

a second rod member including a head and a shaft extending from the head, the shaft including a threaded portion, the shaft positionable in the slot in the second projection, the threaded portion of the shaft positioned in the threaded opening of the second block, the head of the second rod member sized larger than a width of the slot, a portion of the second projection positionable between the head of the second rod member and the second block.

20. The apparatus of claim 19, wherein the first rod member and the second rod member are interchangeable depending upon the orientation of the cover relative to the collar.

21. The apparatus of claim 15, wherein the cover includes two spaced apart rails projecting outwardly from the cover and positioned on opposite sides of the head of the rod member.

22. The method of claim 4, further comprising the steps of:

providing the threaded adjusting means with a threaded bolt having a head with a plurality of flat sides; and engaging one of the flat sides with a portion of the cover to limit rotation of threaded bolt once the bolt is adjusted.

* * * * *

UNITED STATES PATENT AND TRADEMARK OFFICE
CERTIFICATE OF CORRECTION

PATENT NO. : 5,366,317

DATED : November 22, 1994

INVENTOR(S) : Keith F. Solimar

It is certified that error appears in the above-identified patent and that said Letters Patent is hereby corrected as shown below:

Column 3, line 20, "cart" should read --car,--.

Column 9, claim 15, line 30, insert --therefrom-- after the word "axially".

Column 9, claim 15, line 30, delete "and threaded" after the word "axially". (Should read --therefrom to engage-- after the word "axially").

Signed and Sealed this

Twenty-eight Day of March, 1995

Bruce Lehman

*Attest:*

BRUCE LEHMAN

*Attesting Officer*

*Commissioner of Patents and Trademarks*